US010344596B2

(12) United States Patent
Whitten et al.

(10) Patent No.: US 10,344,596 B2
(45) Date of Patent: Jul. 9, 2019

(54) GAS TURBINE ENGINE TIE BOLT ARRANGEMENT

(71) Applicant: Rolls-Royce Corporation, Indianapolis, IN (US)

(72) Inventors: Michael R. Whitten, Zionsville, IN (US); Brandon Snyder, Greenwood, IN (US)

(73) Assignee: ROLLS-ROYCE CORPORATION, Indianapolis, IN (US)

( * ) Notice: Subject to any disclaimer, the term of this patent is extended or adjusted under 35 U.S.C. 154(b) by 268 days.

(21) Appl. No.: 15/584,946

(22) Filed: May 2, 2017

(65) Prior Publication Data

US 2018/0320524 A1 Nov. 8, 2018

(51) Int. Cl.
*F01D 5/06* (2006.01)
*F01D 11/00* (2006.01)

(52) U.S. Cl.
CPC ..... *F01D 5/066* (2013.01); *F01D 11/001* (2013.01)

(58) Field of Classification Search
CPC ..... F04D 29/266; F04D 29/321; F01D 5/066
See application file for complete search history.

(56) References Cited

U.S. PATENT DOCUMENTS

| | | | | |
|---|---|---|---|---|
| 6,663,343 | B1 | 12/2003 | Anderson | |
| 7,147,436 | B2 | 12/2006 | Suciu et al. | |
| 7,452,188 | B2 | 11/2008 | Bouchard | |
| 8,517,687 | B2 * | 8/2013 | Benjamin | F01D 5/066 416/198 A |
| 9,556,894 | B2 | 1/2017 | Coffin | |
| 2012/0107098 | A1 | 5/2012 | Tirone, III et al. | |
| 2016/0376889 | A1 | 12/2016 | Rawe et al. | |

* cited by examiner

*Primary Examiner* — Richard A Edgar
(74) *Attorney, Agent, or Firm* — Duane Morris LLP

(57) ABSTRACT

A rotor stack assembly and method of assembling same. The rotor stack assembly comprises a tie bolt, at least one rotor disk, and a stub shaft. The rotor disk and stub shaft are carried by the tie bolt. The stub shaft is threadably engaged with a threaded end of the tie bolt and comprises a rotatable seal member and an engagement surface for contacting the rotor disk. Engagement of the stub shaft with tie bolt allows for tensioning and pre-loading of the tie bolt to desired levels.

19 Claims, 7 Drawing Sheets

GAS TURBINE ENGINE TIE BOLT ARRANGEMENT

FIELD OF THE DISCLOSURE

The present disclosure relates generally to turbine machines, and more specifically to a tie bolt arrangement for a gas turbine engine rotor assembly.

BACKGROUND

Gas turbine engines typically include at least a compressor section, a combustor section, and a turbine section. In general, during operation, air is pressurized in the compressor section and is mixed with fuel and burned in the combustor section to generate hot combustion gases. The hot combustion gases flow through the turbine section, which extracts energy from the hot combustion gases to power the compressor section and other gas turbine engine loads.

The compressor section and the turbine section may each include alternating rows of rotor and stator assemblies. The rotor assemblies carry rotating blades that create or extract energy (in the form of pressure) from the core airflow that is communicated through the gas turbine engine. The stator assemblies include stationary structures called stators or vanes that direct the core airflow to the blades to either add or extract energy.

A rotor assembly typically comprises a rotor disk carrying a plurality of blades spaced about the circumference of the rotor disk. Multiple rotor assemblies are arranged axially along one or more engine shafts to form a rotor stack, and one or more rotor stacks typically comprise the compressor section or turbine section of the engine. Tie bolts—also referred to as tie shafts or tie rods—are used to axially compress, or clamp, a rotor stack. Tie bolts extend axially, typically parallel and concentric with the axis of rotation of the engine, and react the aerodynamic loading of the blades of the rotor assemblies caused by air and/or combustion gasses acting on the blades.

BRIEF DESCRIPTION OF THE DRAWINGS

The following will be apparent from elements of the figures, which are provided for illustrative purposes and are not necessarily to scale.

Figure 1:
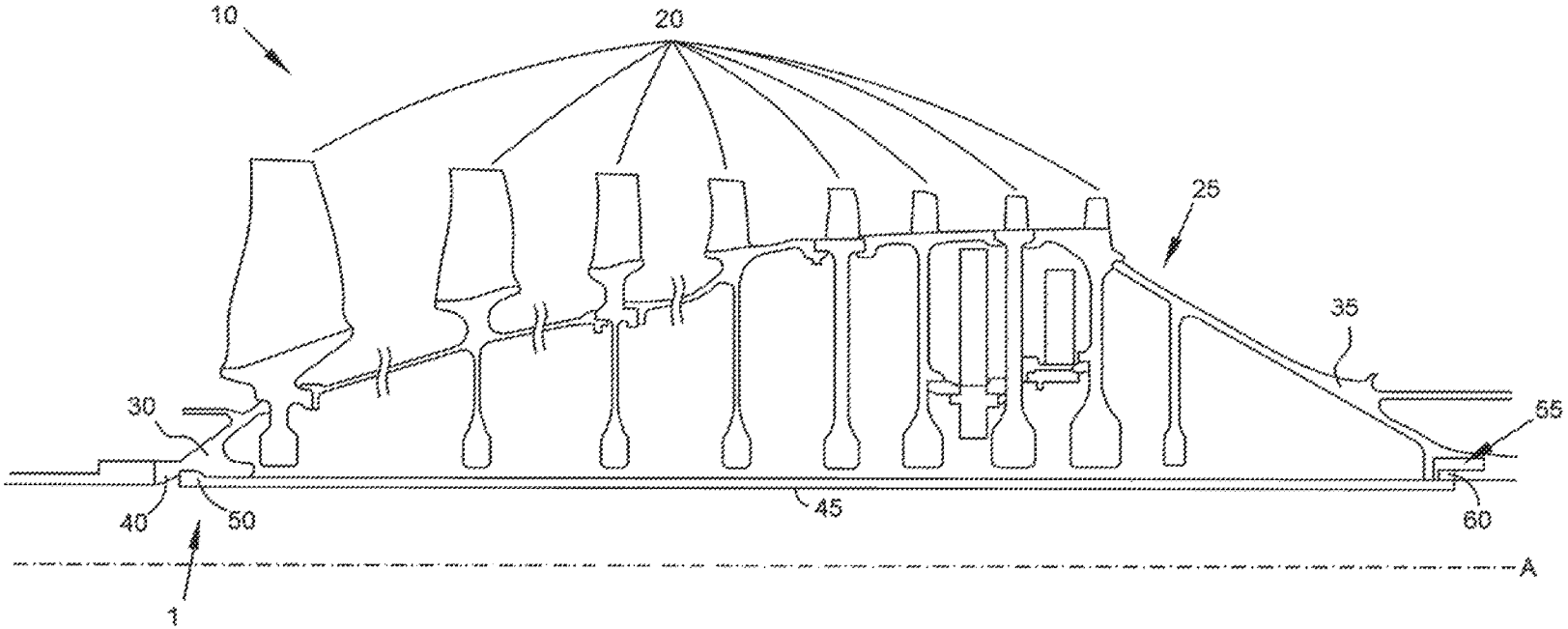
FIG. 1 is a partial cross-sectional view of a compressor section of a gas turbine engine having a tie bolt.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the disclosure as defined by the appended claims.

DETAILED DESCRIPTION

For the purposes of promoting an understanding of the principles of the disclosure, reference will now be made to a number of illustrative embodiments illustrated in the drawings and specific language will be used to describe the same.

A tie bolt arrangement 1 for a compressor section 10 of a gas turbine engine is illustrated in FIG. 1. Compressor section 10 includes a longitudinal stack of juxtaposed bladed compressor disks 20 disposed within a hub 25 comprising forward portion 30 and aft portion 35, which compressively retain (clamp) the disks 20 therebetween.

Forward compressor hub portion 30, also known in the art as a forward stub shaft, may be threaded at a forward end 40 thereof. A tie bolt 45 extends through and engages compressor hub 25. Tie bolt 45 may comprise a threaded forward end 50, and engagement with hub 25 may be accomplished by threaded engagement of threaded forward end 50 of tie bolt 45 with a threaded forward end 40 of front stub shaft 30.

Aft end of tie bolt 45 may be threaded and configured to receive a spanner nut 60 proximate the aft end of aft end portion 35 of compressor hub 25. Threaded engagement of the spanner nut 60, which may engage a flange 55, on the aft end of tie bolt 45 compressively retains the stack of bladed disks 20 between front stub shaft 30 and aft end portion 35 of hub 25 and compressively preloads disks 20 within hub 25.

Figure 2:
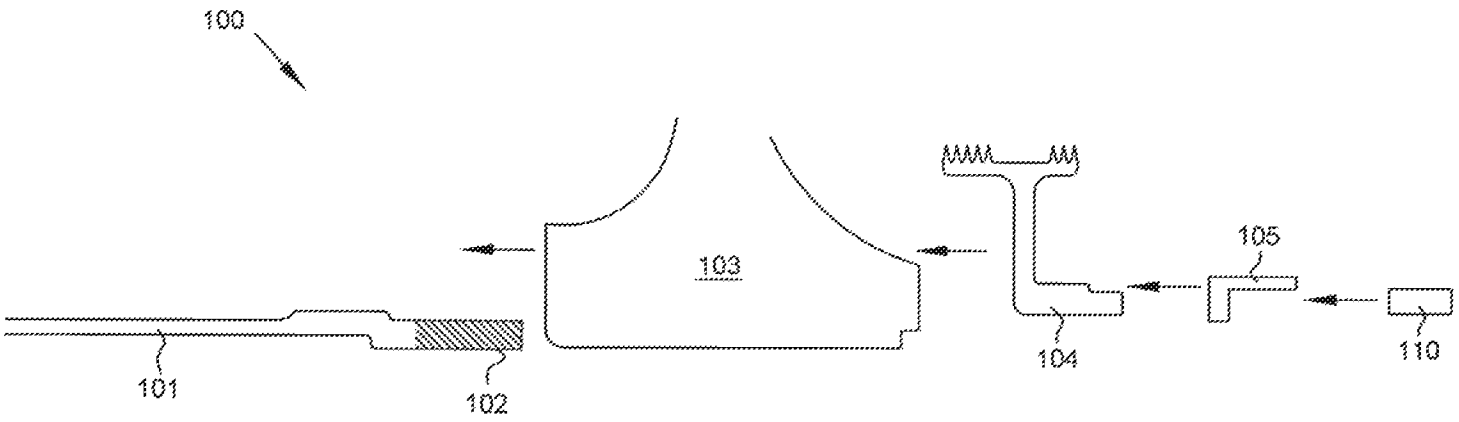
FIG. 2 is a cross-sectional view of a schematic for assembling a portion of a typical rotor stack with a tie bolt.
Figure 3:
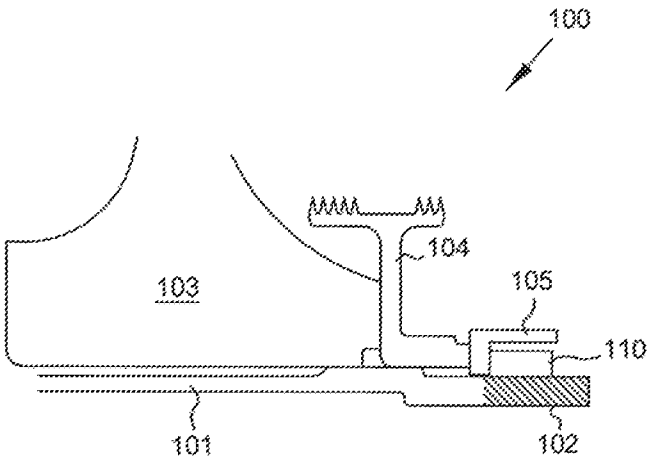
FIG. 3 is a schematic cross-section of a portion of a typical rotor stack with a tie bolt, assembled as indicated in FIG. 2.

FIG. 2 is a cross-sectional view of a schematic for assembling a portion of a typical rotor stack assembly 100 with a tie bolt 101. FIG. 3 is a schematic cross-section of a portion of a typical rotor stack assembly 100 with a tie bolt 101, assembled as indicated in FIG. 2.

As described above, the tie bolt 101 is utilized for providing a compressive or clamping force to axially retain a rotor assembly or rotor stack together. During assembly, a tie bolt 101 is typically stretched using tooling, and a spanner nut 110 is threaded onto a threaded end 102 of the tie bolt 101 to retain the desired tie bolt stretch and pre-load the assembly 100 or a portion thereof.

Prior to application of the spanner nut 110 to threaded end 102, the various components to be retained by the tie bolt 101 are arranged on the tie bolt 101. This is typically accomplished by advancing the components axially along the tie bolt 101; in the illustrated example, the rotor disk 103 and seal member 104 are advanced in an axially forward direction.

In some embodiments, the components may be interference fit to the tie bolt 101. However, in a typical arrangement one or more rotor disks 103 are arranged on the tie bolt 101 and not interference fit to the tie bolt 101. Rather, components are interference fit to axially adjacent components, and then rotatable seal member 104 is interference fit onto the tie bolt 101. The axially extending interference fit between adjacent components is held in place by a spanner nut 110 that holds each of the components centered relative to each other and the tie bolt 101.

In some embodiments a mating flange 105 may be included in the assembly as shown. In some embodiments, mating flange 105 is a washer or a lock washer having an anti-rotation feature. In some embodiments, mating flange 105 fits along a slot in the tie bolt 101 and is dimpled into the spanner nut 110 to provide an anti-rotation feature.

During assembly, the friction loading of the tie bolt 101 caused by interference fitting of at least seal member 104 must be overcome to correctly position the components and pre-load the assembly. These assembly loads can be extremely high relative to the capability of the tooling and the components. High assembly loads are problematic as they increase the difficulty of manufacture or assembly of the illustrated rotor stack assembly, and they can result in unacceptable or unreliable levels of loading in the assembly.

Components arranged on the tie bolt 101, such as one or more rotor disks 103, can also be difficult to properly center. The radial position of each rotor disk 103 is typically held by axially extending interference fits to adjacent components. Radial positioning is critical to rotor performance, as an uncentered disk 103 will create unacceptable wobble during rotation. Assembly of the rotor stack assembly 100 illustrated in FIGS. 2 and 3 is therefore challenging as each of the one or more rotor disks 103 must be held in its proper radial position until assembly is complete and the spanner nut 110 is attached and exerting axial holding force on the assembly.

Once assembled, as shown in FIG. 3, the assembly 100 comprises a rotor disk 103, rotatable seal member 104, and mating flange 105 carried by the tie bolt 101. Spanner nut 110 if not already is threaded onto threaded end 102 of tie bolt 101 to effect compression of the assembly 100.

Due to the high assembly loading discussed above, it is desirable to improve upon the arrangement illustrated in FIGS. 2 and 3 by reducing the high loading required during assembly and to ease the assembly process by improving systems and methods for centering various components relative to tie bolt 101. The present disclosure provides systems and methods for reducing the high assembly loading by forming an integral seal member and spanner nut to eliminate the need for interference fitting the rotatable seal member 104 (or other component) to tie bolt 101. In alternative embodiments, the present disclosure reduces the high assembly loading by forming an integral rotatable seal, stub shaft and spanner nut to eliminate the need for interference fitting the rotatable seal member 104 to tie bolt 101. The present disclosure further provides an assembly bearing that assists with centering of the rotor disk and integral seal member, stub shaft and spanner nut during assembly.

Figure 4:
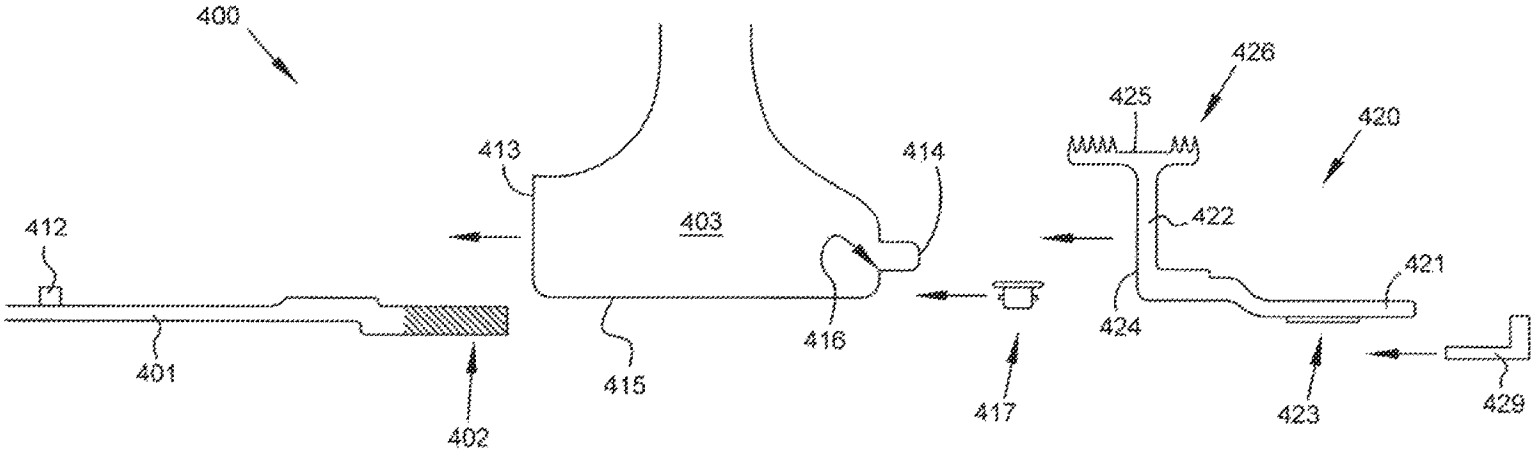
FIG. 4 is a cross-sectional view of a schematic for assembling a portion of a rotor stack assembly with a tie bolt in accordance with some embodiments of the present disclosure.
Figure 5:
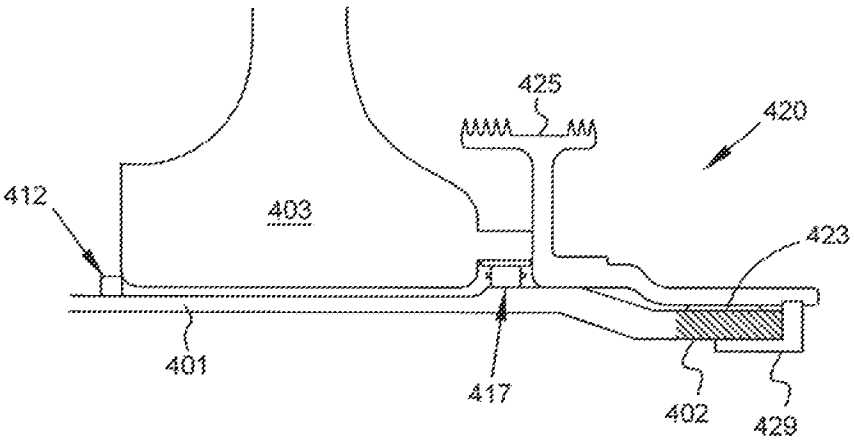
FIG. 5 is a schematic cross-section of a portion of a rotor stack assembly with a tie bolt, assembled as indicated in FIG. 4, in accordance with some embodiments of the present disclosure.

FIG. 4 is a cross-sectional view of a schematic for assembling a portion of a rotor stack assembly 400 with a tie bolt 401 in accordance with some embodiments of the present disclosure. FIG. 5 is a schematic cross-section of a portion of a rotor stack assembly 400 with a tie bolt 401, assembled as indicated in FIG. 4, in accordance with some embodiments of the present disclosure.

Tie bolt 401 comprises an elongate member terminating in a male interface 402. In some embodiments the male interface 402 is disposed at the axially aft, or downstream, end of the tie bolt 401. In some embodiments the axially forward, or upstream, end may be coupled to a forward stub shaft (not shown). Further, in some embodiments tie bolt 401 may comprises one or more axial stops 412 that assist with axially positioning components along the tie bolt 401.

Rotor disk 403 comprises an upstream-facing surface 413, a downstream-facing surface 414, and a radially-inward facing surface 415. Rotor disk 403 may be configured to carry a plurality of blades (not shown) spaced about the circumference of the rotor disk 403. In some embodiments, rotor disk 403 may further comprise a notch 416 on either the upstream or downstream side, the notch 416 configured to accommodate a seal, bearing, or assembly bearing.

In some embodiments rotor stack assembly 400 further comprises an assembly bearing 417 that is used during assembly of the rotor stack assembly 400 to properly center the rotor disk 403 or other components positioned on or carried by the tie bolt 401. The assembly bearing 417 assists during the assembly process but may be fixed with respect to the tie bolt 401 and rotor disk 403 during operation. By providing a structure for centering the rotor disk 403 relative to the tie bolt 401 during assembly, assembly bearing 417 allows a reduction in high contact loading required during the assembly process. In embodiments having multiple rotor disks 403 upstream of the assembly bearing 417, the assembly bearing 417 allows for centering the final rotor disk 403 relative to tie bolt 401 and combining hardware aft of the assembly bearing 417 into a single component as described below.

An aft stub shaft 420 is provided that is, conceptually, an integrally-formed component combining the rotatable seal member 104 and spanner nut 110. Aft stub shaft 420 comprises an axially-extending member 421 and a radially-extending member 422. Member 421 defines a female interface 423 that, in some embodiments, may comprise buttress threads which are complementary to the buttress threads of male interface 402 of tie bolt 401. Member 422 defines a forward engagement surface 424 of the stub shaft 420, and may terminate in a sealing member 425. Sealing member 425 may comprise a plurality of sealing ridges 426, or knives, that, when mated to an engagement surface of another component, form a labyrinth seal. Stub shaft 420 may be generally cylindrical.

In some embodiments rotor stack assembly 400 further comprises a retaining clip 429, retaining ring, or similar rotational locking device. The retaining clip 429 or similar device prevents rotation of stub shaft 420 relative to tie bolt 401, thus preventing during operation the axial advancement or retreat of stub shaft 420 relative to tie bolt 401 and maintaining the tension of the tie bolt 401.

In some embodiments rotor stack assembly 400 further comprises additional turbine components disposed between rotor disk 403 and stub shaft 420. By way of example, additional rotor disks, rotatable seal elements, bearings, and axial spacers may be carried by the disclosed tie bolt 401 and clamped using the disclosed tie bolt arrangement.

In assembling the rotor stack assembly 400, rotor disk 403 is positioned on tie bolt 401. In some embodiments the rotor disk 403 may be moved axially along the tie bolt 401 until contacting axial stop 412 by the external tooling and then by the engagement of the threaded interface of the stub shaft 420. In some embodiments an assembly bearing 417 is used to assist with centering the rotor disk 403. In some embodiment rotor disk 403 may be positioned by interference fit to the tie bolt 401, to an adjacent rotor disk 403, and/or to another adjacent component such as stub shaft 420. In some embodiments external tooling may be used to assist with positioning the rotor disk 403.

Once rotor disk 403 is positioned on tie bolt 401, stub shaft 420 is threadably engaged to tie bolt 401 by engaging the female interface 423 with male interface 402. Stub shaft 420 is rotated relative to tie bolt 401 to advance stub shaft 420 axially along the tie bolt 401. Stub shaft 420 is axially advanced until it contacts, or abuts, rotor disk 403 with the forward engagement surface 424, pushes the rotor disk 403 axially until axial motion ceases relative to the tie bolt 401, and/or achieves a desired tension and/or pre-loading of the tie bolt 401.

The use of the disclosed stub shaft 420 therefore eliminates the need for separate positioning of the rotatable seal member 104, and use of spanner nut 110 and mating flange 105.

Once assembled, as is evident in FIG. 5, rotor stack assembly 400 comprises tie bolt 401, rotor disk 403, and stub shaft 420. Rotor disk 403 and stub shaft 420 are carried by tie bolt 401, and the engagement of male interface 402 of tie bolt 401 with female interface 423 of stub shaft 420 allows for tensioning of the tie bolt 401 to a desired pre-loaded condition. Engagement of female interface 423 onto male interface 402 may be assisted by external tooling to achieve the desired tension and pre-loading of tie bolt 401. Further the tension and pre-loading of tie bolt 401 may be adjusted by increasing or decreasing the threaded engagement of male interface 402 with female interface 423.

In some embodiments axial contact points, such as axial stop 412, may be integrally formed with or attached to tie bolt 401 to assist with positioning the various components such as rotor disk 403 along the tie bolt 401. In other embodiments, radial fitting may be used to position the components along the tie bolt 401.

In some embodiments a rotor stack assembly 400 comprises a tie bolt 401, rotor disk 403, bearing 417, seal member 104, and spanner nut 110. During assembly, rotor disk 403 is arranged on but not interference fit to tie bolt 401. Bearing 417 is arranged on tie bolt 401 and used to center rotor disk 403 relative to tie bolt 401. Seal member 104 and spanner nut 110 are used to axially engage and retain rotor disk 403.

Figure 6:
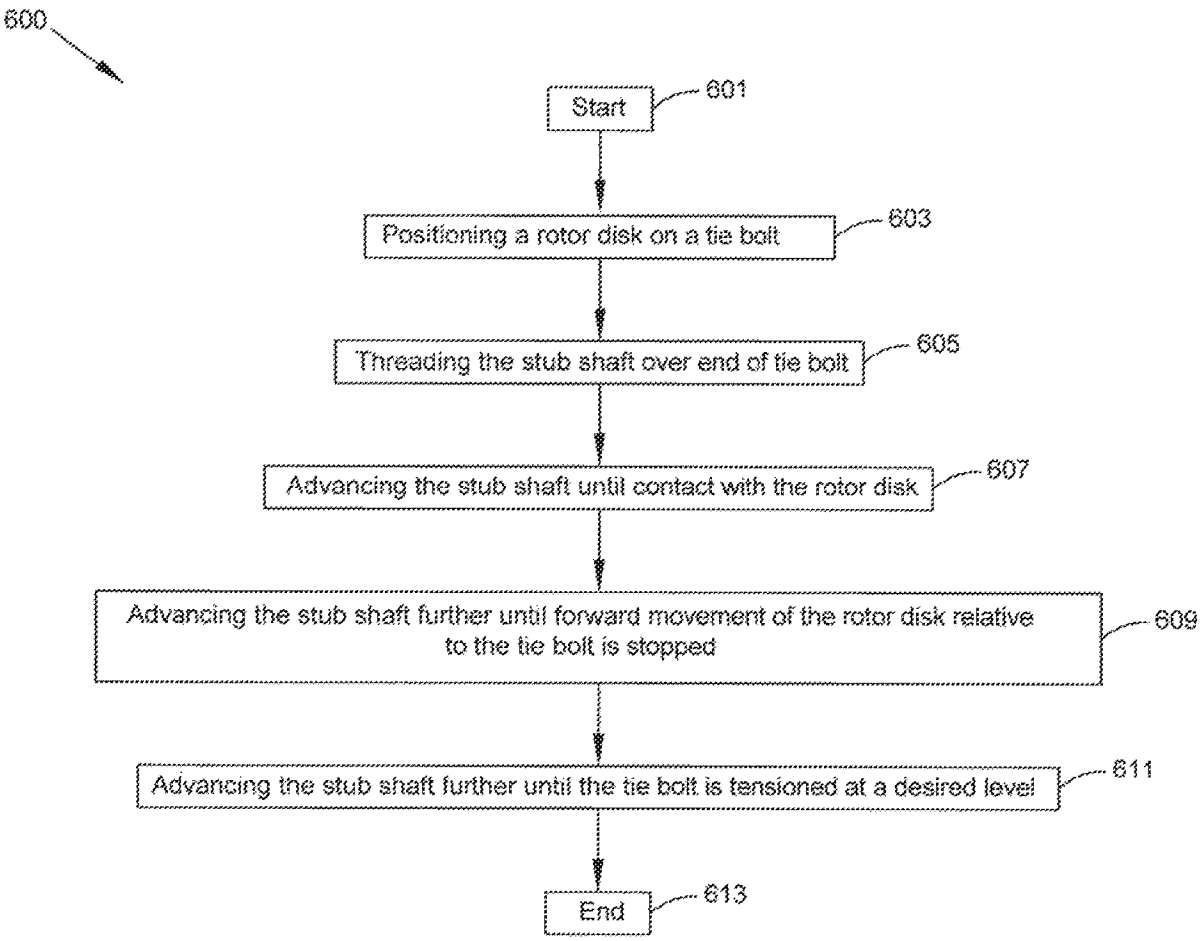
FIG. 6 is a flow diagram of a method in accordance with some embodiments of the present disclosure.

The present disclosure further provides methods of assembling a rotor stack assembly and tensioning a tie bolt of that assembly. For example, FIG. 6 is a flow diagram of one method 600 in accordance with some embodiments of the present disclosure. The method 600 of FIG. 6 begins with Start at Block 601. A tie bolt is provided having an axial stop and a threaded end. A rotor disk is positioned along the tie bolt at Block 603. In some embodiments the rotor disk is positioned to abut the axial stop.

A stub shaft is provided comprising a rotatable seal member, a forward engagement surface, and a threaded portion. At Block 605, the stub shaft is threaded over the threaded end of the tie bolt. The stub shaft is then advanced axially along the tie bolt by threaded engagement of the stub shaft to the threaded end of the tie bolt at Blocks 607, 609, and 611. Each of Blocks 607, 609, and 611 typically require rotation of the stub shaft relative to the tie bolt for threadable engagement of stub shaft and tie bolt threads. The advancement of the stub shaft along the tie bolt may be sequential (i.e., may comprise discrete steps wherein the advancing is halted between steps) or may be continuous.

Specifically, at Block 607 the stub shaft is advanced axially to effect contact of the forward engagement surface of the stub shaft with the rotor disk. At Block 609 the stub shaft is advanced axially to push the rotor disk axially along the tie bolt until the movement of the rotor disk relative to the tie bolt is ceased. In some embodiments this step comprises advancing the stub shaft and rotor disk axially until the rotor disk contacts the axial stop, thus ceasing axial movement of the rotor disk. At Block 611 the stub shaft is further advanced to achieve tensioning of the tie bolt. In some embodiments the stub shaft is advanced until a desired tension or pre-loading of the tie bolt is accomplished. Method 600 ends at Block 613.

In some embodiments method 600 additionally comprises centering the rotor disk on the tie bolt. Centering of the rotor disk may be accomplished with the use of an assembly bearing. In some embodiments method 600 additionally comprises restricting or preventing relative rotation between the tie bolt and the stub shaft once the desired tensioning of the tie bolt is achieved. Restricting or preventing relative movement between the tie bolt and stub shaft may involve the use of a retaining clip, retaining ring, or other rotational locking device.

In some embodiments method 600 further comprises the use of external tooling during one or more of the steps at Blocks 603, 605, 607, 609, or 611.

Figure 7:
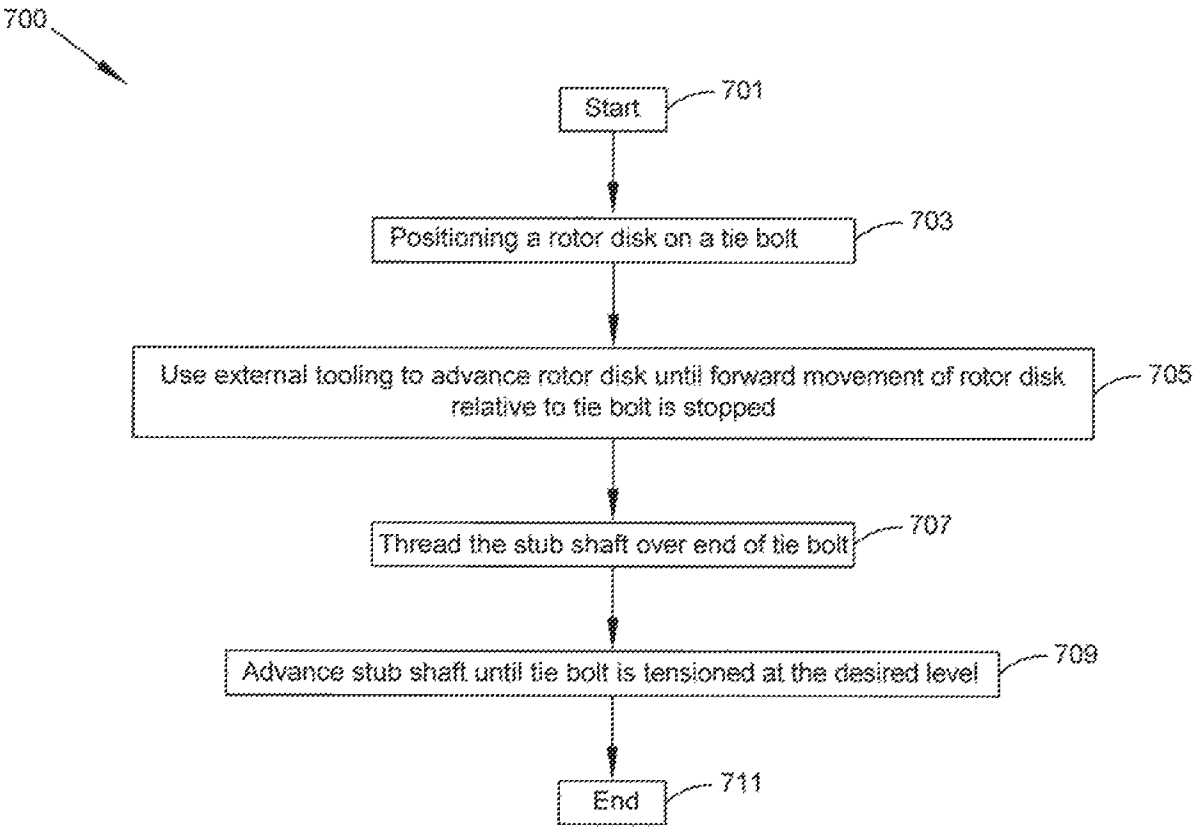
FIG. 7 is a flow diagram of a method in accordance with some embodiments of the present disclosure.

FIG. 7 is a flow diagram of a method 700 in accordance with some embodiments of the present disclosure. The method 700 of FIG. 7 begins with Start at Block 701. At Block 703 a rotor disk is positioned on a tie bolt. The rotor disk is axially advanced using external tooling at Block 705 until forward movement of the rotor disk relative to the tie bolt is stopped. For example, in some embodiments the rotor disk is advanced until contacting an axial stop of the tie bolt.

At Block 707 a stub shaft is threadably engaged with the tie bolt, and at Block 709 the stub shaft is axially advanced until the tie bolt is tensioned to a desired level. In some embodiments, Block 709 includes rotating the stub shaft relative to the tie bolt to effect threadable engagement. In some embodiments, Block 709 includes axially advancing the stub shaft to contact a forward engagement surface of the stub shaft with the rotor disk.

The present disclosure provides numerous advantages over prior art rotor assemblies and tie bolt arrangements. Most significantly, the systems and methods herein disclosed reduce the loading that occurs during assembly of a rotor assembly caused by interference fitting one or more components onto the tie bolt. The provision of an assembly bearing assists with centering of components during the assembly process, most notably the rotor disk. This improves the ease of assembly or manufacturing and reduces the stresses induced on the rotor assembly to improve lifespan.

The present application discloses one or more of the features recited in the appended claims and/or the following features which, alone or in any combination, may comprise patentable subject matter.

According to aspects of the present disclosure, a rotor stack assembly comprises a tie bolt, a cylindrical stub shaft, and a disk. The tie bolt has a first end and a second end, the second end defining a male interface, the male interface having a portion with buttress threads. The cylindrical stub shaft defines a female interface comprising complementary buttress threads to the buttress threads of the male interface. The cylindrical stub shaft comprises a rotatable seal member radially extending upstream of the female interface. The disk is carried by the tie bolt, wherein an upstream end of the female interface abuts a downstream surface of the disk and wherein the tie bolt and cylindrical stub are jointed via reception of the male interface within the female interface.

In some embodiments the female interface is threaded onto the male interface via the complementary buttress threads and buttress threads respectively. In some embodiments the rotor stack assembly has the same nominal outer diameter at the tie bolt and the stub shaft. In some embodiments the assembly further comprises a rotational locking device to prevent unwanted relative rotation between the tie bolt and the stub shaft. In some embodiments the assembly further comprises a bearing upstream of the female interface for centering the disk.

In some embodiments the disk is restrained from forward axial movement by a stop proximate the first end of the tie bolt and from rearward axial movement by the female interface. In some embodiments a plurality of components are arranged on the tie bolt between the stop and the disk. In some embodiments the tie bolt is tensioned by the interaction of the female interface with the disk and the male interface.

According to some aspects of the present disclosure, a method is disclosed of tensioning a tie bolt having a stop at a first end and a second end that is threaded, and at least one disk positioned along the tie bolt. The method comprises providing a stub shaft having a rotatable seal member, a forward engagement surface and a threaded portion; threading the stub shaft over the second end of the tie bolt; advancing the stub shaft until the forward engagement surface contacts the at least one disk; advancing the stub shaft further until the forward movement of the at least one disk relative to the tie bolt is stopped; and advancing the stub shaft further until the tension in the tie bolt is at a desired level.

In some embodiments the method further comprises providing a bearing to center the disk on the tie bolt. In some embodiments the method further comprises restricting relative rotation between the tie bolt and the stub shaft with the desired level is reached.

In some embodiments the step of restricting relative rotation is with a retaining clip or ring. In some embodiments the step of advancing the stub shaft until the tension in the tie bolt is at the desired level comprises rotating the stub shaft relative to the tie bolt. In some embodiments the step of advancing the stub shaft until the forward movement of the at least one disk relative to the tie bolt is stopped comprises rotating the stub shaft relative to the tie bolt.

In some embodiments the step of advancing the stub shaft until the forward movement of the at least one disc relative to the tie bolt is stopped comprises pushing the stub shaft with external tooling. In some embodiments the step of advancing the stub shaft until the forward engagement surface contacts the at least one disk, comprises rotating the stub shaft relative to the tie bolt. In some embodiments the step of advancing the stub shaft until the forward engagement surface contacts the at least one disk comprises pushing the stub shaft with external tooling.

According to some aspects of the present disclosure, a rotor stack assembly comprises a first shaft segment; at least one disk positioned on and concentric with the first shaft segment; at least one turbine component concentric with and overlapping the first shaft segment and having a forward portion pressed against a rear portion of the at least one disk; a second shaft segment concentric with the first shaft segment and threaded onto a threaded portion the first shaft segment; the at least one turbine component integral with the second shaft segment; and, an anti-rotation device attached preventing relative rotation between the first and second shaft segments; wherein the at least one disk and the at least one turbine component are in compression and the first shaft segment is in tension in the axial direction.

In some embodiments the at least one turbine component is selected from the group consisting of rotatable seal element, bearing, and axial spacer.

Although examples are illustrated and described herein, embodiments are nevertheless not limited to the details shown, since various modifications and structural changes may be made therein by those of ordinary skill within the scope and range of equivalents of the claims.

What is claimed is:

1. A rotor stack assembly comprising:

a tie bolt having a first end and a second end, said second end defining a male interface, the male interface having a portion with buttress threads;

a cylindrical stub shaft defining a female interface comprising complementary buttress threads to the buttress threads of the male interface, wherein the cylindrical stub shaft comprises a rotatable seal member radially extending upstream of the female interface;

a disk carried by the tie bolt, wherein an upstream end of the female interface abuts a downstream surface of the disk and wherein the tie bolt and cylindrical stub are jointed via reception of the male interface within the female interface.

2. The assembly of claim 1, wherein the female interface is threaded onto the male interface via the complementary buttress threads and buttress threads respectively.

3. The assembly of claim 2, further comprising a rotational locking device to prevent unwanted relative rotation between the tie bolt and the stub shaft.

4. The assembly of claim 1, wherein the rotor stack assembly has the same nominal outer diameter at the tie bolt and the stub shaft.

5. The assembly of claim 1 further comprising a bearing upstream of the female interface for centering the disk.

6. The assembly of claim 1, wherein the disk is restrained from forward axial movement by a stop proximate the first end of the tie bolt and from rearward axial movement by the female interface.

7. The assembly of claim 6, wherein a plurality of components are arranged on the tie bolt between the stop and the disk.

8. The assembly of claim 1 wherein the tie bolt is tensioned by the interaction of the female interface with the disk and the male interface.

9. A method of tensioning a tie bolt having a stop at a first end and a second end that is threaded, and at least one disk positioned along the tie bolt, the method comprising:

providing a stub shaft having a rotatable seal member, a forward engagement surface and a threaded portion;

threading the stub shaft over the second end of the tie bolt;

advancing the stub shaft until the forward engagement surface contacts the at least one disk;

advancing the stub shaft further until the forward movement of the at least one disk relative to the tie bolt is stopped; and advancing the stub shaft further until the tension in the tie bolt is at a desired level.

10. The method of claim 9, further comprising providing a bearing to center the disk on the tie bolt.

11. The method of claim 9, further comprising restricting relative rotation between the tie bolt and the stub shaft with the desired level is reached.

12. The method of claim 11, wherein the step of restricting relative rotation is with a retaining clip or ring.

13. The method of claim 9, wherein the step of advancing the stub shaft until the tension in the tie bolt is at the desired level comprises rotating the stub shaft relative to the tie bolt.

14. The method of claim 13, wherein the step of advancing the stub shaft until the forward movement of the at least one disk relative to the tie bolt is stopped comprises rotating the stub shaft relative to the tie bolt.

15. The method of claim 14, wherein the step of advancing the stub shaft until the forward engagement surface contacts the at least one disk, comprises rotating the stub shaft relative to the tie bolt.

16. The method of claim 14, wherein the step of advancing the stub shaft until the forward engagement surface contacts the at least one disk comprises pushing the stub shaft with external tooling.

17. The method of claim 13, wherein the step of advancing the stub shaft until the forward movement of the at least one disc relative to the tie bolt is stopped comprises pushing the stub shaft with external tooling.

18. A rotor stack assembly comprising:

a first shaft segment;

at least one disk positioned on and concentric with the first shaft segment;

at least one turbine component concentric with and overlapping the first shaft segment and having a forward portion pressed against a rear portion of the at least one disk;

a second shaft segment concentric with the first shaft segment and threaded onto a threaded portion the first shaft segment;

the at least one turbine component integral with the second shaft segment; and, an anti-rotation device attached preventing relative rotation between the first and second shaft segments;

wherein the at least one disk and the at least one turbine component are in compression and the first shaft segment is in tension in the axial direction.

19. The assembly of claim 18, wherein the at least one turbine component is selected from the group consisting of rotatable seal element, bearing, and axial spacer.

* * * * *